US006102197A

United States Patent [19]

Negelen

[11] Patent Number: 6,102,197

[45] Date of Patent: Aug. 15, 2000

[54] CONTAINERS FOR ARTICLES

[75] Inventor: Emanuel Negelen, Schweich, Germany

[73] Assignee: Riverwood International Corporation, Atlanta, Ga.

[21] Appl. No.: 09/171,714

[22] PCT Filed: Apr. 25, 1997

[86] PCT No.: PCT/GB97/01149

§ 371 Date: Apr. 6, 1999

§ 102(e) Date: Apr. 6, 1999

[87] PCT Pub. No.: WO97/41036

PCT Pub. Date: Nov. 6, 1997

[30] Foreign Application Priority Data

Apr. 26, 1996 [GB] United Kingdom ..... 9608694

[51] Int. Cl.[7] ..... B65D 71/52

[52] U.S. Cl. ..... 206/193; 206/162

[58] Field of Search ..... 206/139, 162, 206/170–172, 180–194; 220/509

[56] References Cited

U.S. PATENT DOCUMENTS

| | | | |
|---|---|---|---|
| 2,525,686 | 10/1950 | Kowal | 206/185 |
| 2,712,397 | 7/1955 | Kowal | 206/191 |
| 2,785,827 | 3/1957 | Forrer | 206/188 |
| 3,198,381 | 8/1965 | Gioia | 220/115 |
| 3,971,468 | 7/1976 | Helms et al. | 206/193 |
| 4,927,009 | 5/1990 | Stout | 206/188 |
| 5,069,335 | 12/1991 | Beales | 206/180 |
| 5,518,110 | 5/1996 | Harrelson | 206/170 |
| 5,531,319 | 7/1996 | Harrelson | 206/170 |
| 5,538,131 | 7/1996 | Harrelson | 206/170 |

FOREIGN PATENT DOCUMENTS

| | | | |
|---|---|---|---|
| 0 302 563 | 2/1989 | European Pat. Off. | B65D 5/48 |

*Primary Examiner*—Jim Foster

*Attorney, Agent, or Firm*—Womble Carlyle Sandridge & Rice, PLLC

[57] ABSTRACT

There is provided a basket type carrier device for a plurality of articles which comprises a lengthwise extending central wall 51, articles receiving compartments disposed on both sides of the central wall 51, and a handle portion 70. Each receiving compartment is defined by a base wall 63, a side wall 61, 62 which is substantially parallel to the central wall 51, and a pair of end walls 58, 65 and 59, 66 which extend between and are hingedly connected to the side 61, 62 and the central wall 51. The adjacent pairs of end walls 58, 65 and 59, 66 are secured together so that said adjacent end walls are coplanar and are unable to hinge relative to each other.

16 Claims, 8 Drawing Sheets

CONTAINERS FOR ARTICLES

BACKGROUND OF THE INVENTION

1. Field of the Invention

This invention relates to containers for articles and more particularly to basket style containers usually for carrying bottles.

2. Description of the Related Art

Basket style containers are known and normally have a central wall which leads into an upstanding handle portion. On each side of the central wall is an open topped compartment section for receiving a number of bottles. Further divider walls may also be provided inside each compartment section so as to define individual pockets for each bottle. When fully erected, the container has a base, a pair of end wall means generally perpendicular to the central wall and a pair of side walls generally parallel to the central wall and hingedly connected to the end walls.

It is common for the containers to be supplied to an end user, such as a beverage manufacturer, in a flat condition either fully glued or glued except for closing two base panels. The end user then runs the containers on a packing machine which opens the containers and inserts the bottles, having closed the base panels where necessary.

In the past, two basic types of container have been produced and each requires a different assembly technique prior to supply to the end user. The different assembly techniques are the result of the basic geometries of the container blanks for producing the two basic types of container. Different machines are, therefore, required to assembly the different blanks.

The first type of container is known as a four-crease basket, the four creases being the substantially vertical creases connecting the side walls and the end wall means at the four comers of the basket. This type of basket is formed from a generally L-shaped blank which results in significant wastage of paperboard and the necessity to glue or interlock the base panels during the packing stage.

The second type of container is known as a six-crease basket, the extra two creases being provided in the end wall means where they meet the central wall. The extra creases are generally parallel to the other four creases. This type of basket is formed from a generally rectangular shaped blank which reduces paperboard wastage and often has a formed base on opening from a flat condition.

SUMMARY OF THE INVENTION

These two types of container will be described in more detail later in the specification.

According to a first aspect of the present invention there is provided a basket type carrier device having a lengthwise extending central wall, article receiving compartments on both sides of the central wall and a handle portion, each receiving compartment being defined by a base wall, a side wall substantially parallel to the central wall and a pair of end walls extending between and hingedly connected to the side wall and the central wall, the adjacent end walls of the two compartments being separately defined but secured together by means of at least one flap projecting without folding from one of the end walls which flap or flaps are adhesively secured to the other adjacent end wall so that each pair of adjacent end walls remain in the same plane as each other and are unable to hinge relative to each other due to said adhesive flap attachment between said adjacent end walls.

Preferably the securing of each pair of adjacent end walls relative to each other is by means of at least one flap projecting from one of the end walls which flap or flaps are adhesively secured to the other adjacent end wall and also the adhesive attachment of said flaps is located on the surface of the other end walls disposed on the inside of the carrier device. Conveniently a single flap secures each pair of adjacent end walls.

In preferred arrangements compartment dividers are folded out from the central wall and are adhesively secured to the side walls.

It is a preferred feature that the central wall comprises two panels lying flat against each other and hingedly connected along a top edge and incorporating handle apertures thereby to constitute at least a part of the handle portion, said central wall panels being hingedly connected to respective first end walls of a pair of adjacent first end walls. In certain arrangements said flap of the first end wall adjacent the central panel is cut from the adjacent central panel and there is a corresponding cut out in the other central panel connected to the other first end wall of the adjacent pair of first end walls, such that in use the flap is located in the cut out when glued to the other first end wall.

Another preferred feature is that the first end walls are hingedly connected to respective side walls which in turn are hingedly connected to respective end walls of the adjacent pair of second end walls. A still further feature is that the second end walls are both hingedly connected to an edge panel, the flap of one of said second adjacent end panels being cut from said edge panel and there is a corresponding cut out in the edge panel adjacent the other of said second end panels, such that in use the flap is located in the cut out in the edge panel which in turn forms a portion of the central wall.

Preferably further handle panels are provided, hingedly connected to the central wall panels and adhesively secured thereto, said further handle panels also being adhesively secured to the edge panel portion of the central wall.

Conveniently the base walls comprise two panels adapted to be secured together either by adhesive or by interlocking formations.

According to a second aspect of the present invention there is provided a paperboard blank for producing the above-described devices.

BRIEF DESCRIPTION OF THE DRAWINGS

Embodiments of the prior art and of the present invention will now be described in more detail with reference to and as illustrated in the accompanying drawings in which.

DETAILED DESCRIPTION OF THE PREFERRED EMBODIMENT

Figure 1:
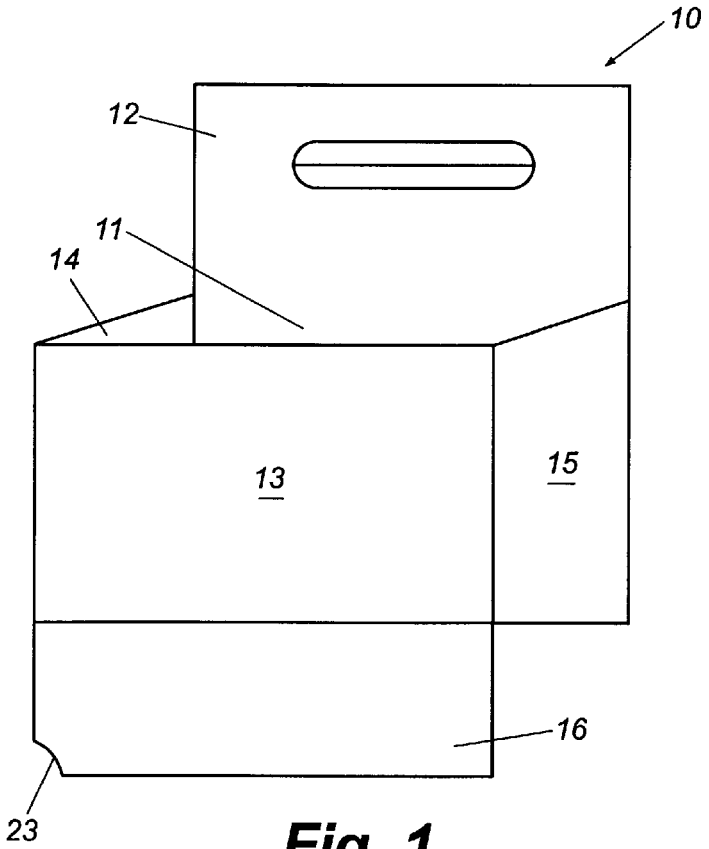
FIG. 1 is a side view of a prior art device.

FIGS 1 to 4 of the drawings relate to prior art arrangements. FIG. 1 is a side view of a six-crease basket type container 10 in a glued form which is generally flat for supply to an end user such as a beverage manufacturer. When run on the packing machine the pack is opened up and bottles (not shown) are inserted into compartments provided on each side of a central wall 11 which extends into a handle portion 12 complete with slot for receiving the fingers of the person carrying the pack.

The side of the pack 10 on the other side of central wall 11 is a mirror image of the side visible in FIG. 1. Each compartment is defined by the central wall 11, a side wall 13, two end walls 14, 15 and a base panel 16. Creases or folds are located at the end of the side wall 13 with its end walls 14, 15 and at the junction of the end walls 14, 15 with the central wall. The junction of the end walls of one side compartment coincide generally with those of the other side compartment, thereby making six generally parallel, vertical creases to form the two compartments. The base panel 16 in this arrangement is shown as a lengthwise folded single panel hingedly connected to the side walls 13 but could comprise two separate panels for subsequent adhesive or interlocking connection to each other.

Figure 2:
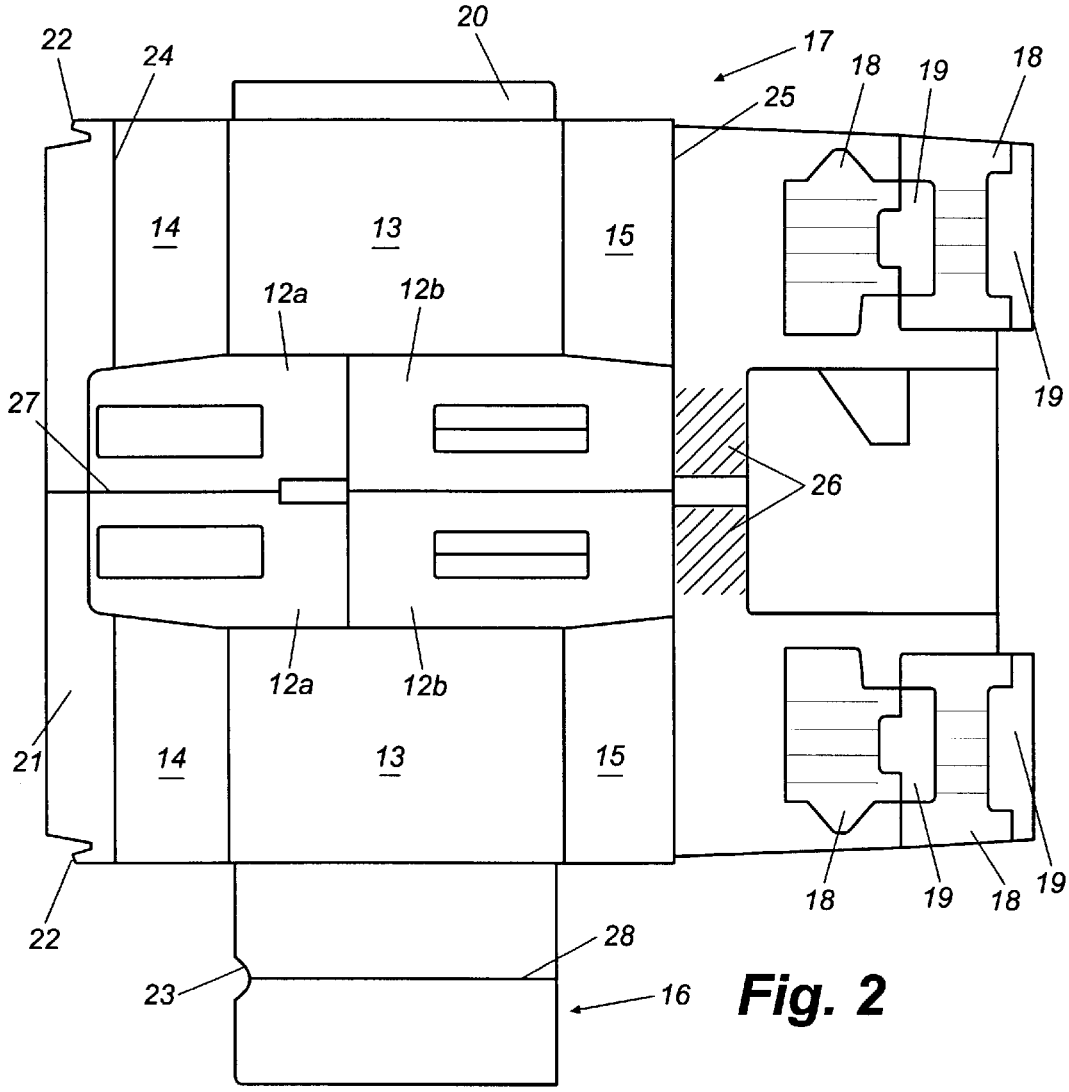
FIG. 2 is a blank for producing the FIG. 1 device.
Figure 4:
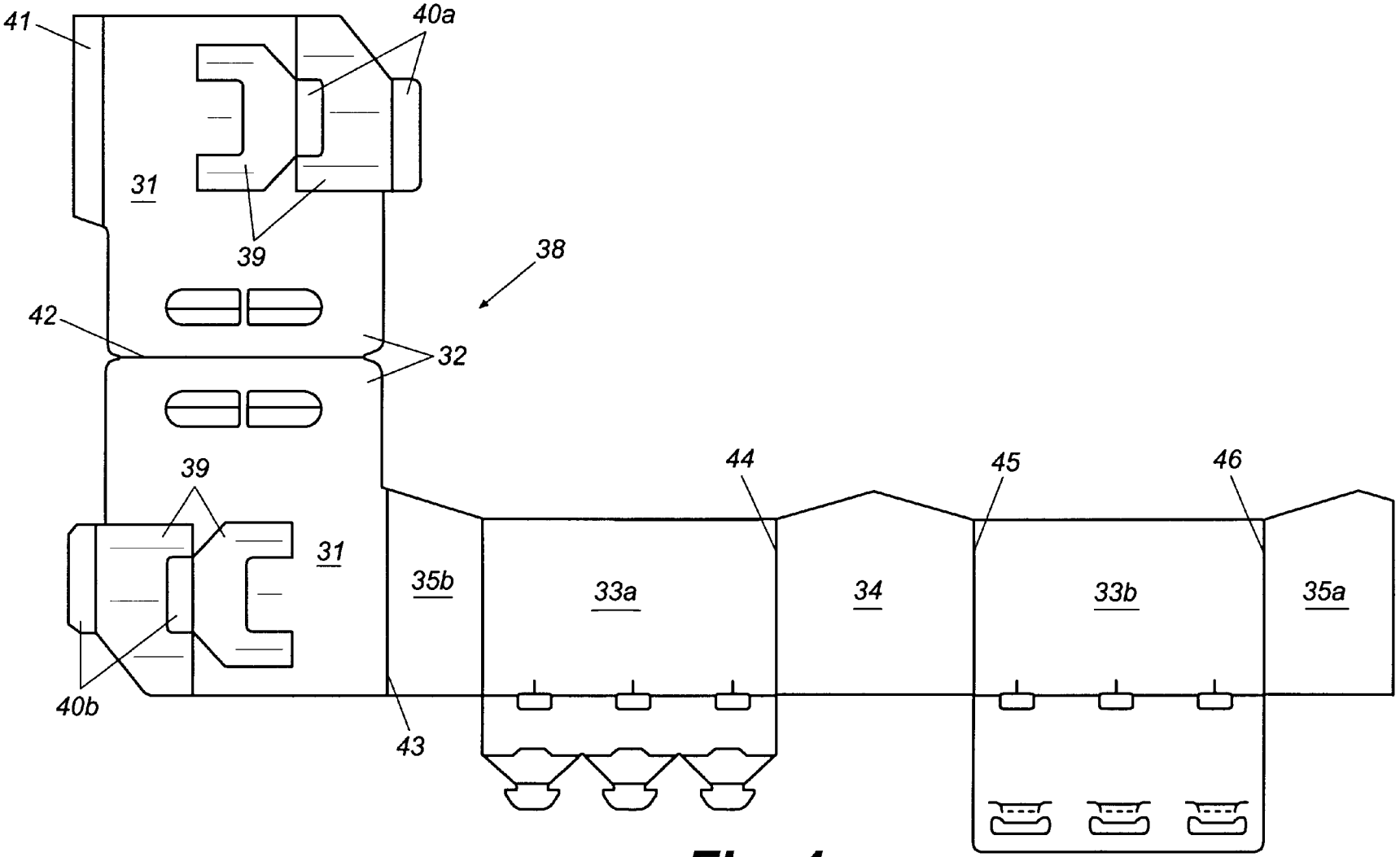
FIG. 4 is a blank for producing the FIG. 3 device.

The FIG. 1 basket 10 is formed from a generally rectangular blank 17 shown in FIG. 2. In addition to the main panels discussed above there are shown in FIG. 2 additional features such as compartment divider panels 18 which are hingedly connected to the central wall panels 11 and which have gluing tabs 19, a base gluing tab 20 hingedly connected to one side wall 13. Also shown is a base locking panel 21 having end barbs 22 for engaging a cut out 23 in the base panel 16.

Assembly of such a blank is known and so will be discussed only briefly. Locking panel 21 is folded about fold 24 and glued to the end walls 14. Handle portions 12*a* are folded about handle portions 12*b* and adhesively secured thereto. Central wall panels 11 are folded about fold 25 and areas 26 are glued to the handle portion 12 whilst the gluing tabs 19 are glued to the side walls 13. The assembly is then folded about central fold 27 and the central wall panels 11 are glued together. The base panel 16 is also folded about its central fold 28 and glued to the base gluing tab 20.

Figure 3:
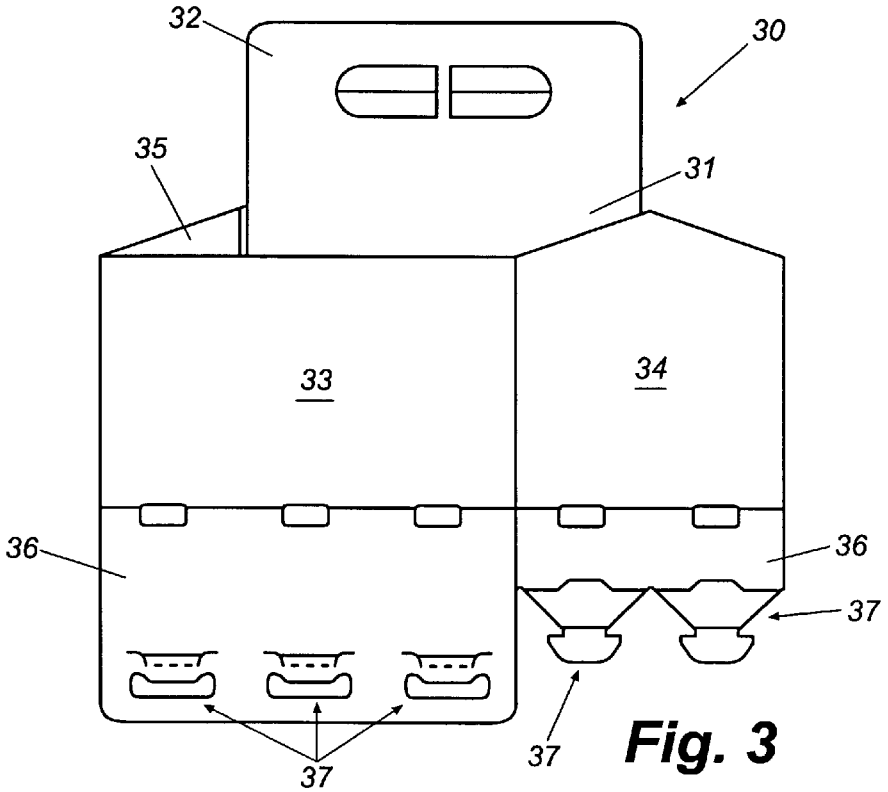
FIG. 3 is a side view of another prior art device.

FIG. 3 is a side view of a four-crease basket type container 30 in a form which is again generally flat for supply to an end user. When fully opened up there are again compartments on each side of a central wall 31 which extends into a handle portion 32 complete with slot for receiving the fingers of the person carrying the pack.

Each compartment is defined by the central wall 31, a side wall 33, two end walls 34, 35 and a base panel 36. Creases or folds are located at the ends of the side wall 33 with its end panels 34, 35. The end walls 34, 35, however, remain substantially planar and adjacent end walls for both compartments do not hinge relative to each other. There are, therefore, four generally parallel, vertical creases to form the two compartments. In this arrangement two base panels are provided, having cooperating interlocking means 37 for connecting the two base panels together in the fully erected basket when ready for bottle insertion.

The FIG. 3 basket is formed from a generally L-shaped blank 38 shown in FIG. 2. In addition to the panels and features discussed above there are shown in FIG. 2 additional features such as compartment divider panels 39 having gluing tabs 40*a*, 40*b* and a central wall gluing tab 41.

Assembly of such a blank 38 is known and so will be discussed only briefly. The two central wall panels and handle portions 32 are folded about fold 42 and glued together. The central wall 31 is then folded about fold 43 and the adjacent tabs 40*a* are glued to the first side wall 33*a*. End panel 34 is then folded over about fold 44 and glued to tab 41. The second side wall 33*b* is then folded about fold 45 and glued to tabs 40*b*. Finally partial end panel 35*a* is then folded about fold 46 and glued to partial end panel 35*b*.

It will, of course, be appreciated that in the above arrangements the blanks 17, 38 are shaped and dimensioned such that the handle apertures coincide and the compartments are rectangular and evenly divided upon folding and gluing.

In FIGS. 5 to 7 and 11 there is shown an embodiment of the present invention. In the blank 50 of FIG. 5 there is provided central wall panels 51, 52 hingedly connected along a central, lengthwise extending fold 53 and incorporating first handle portions 54 which have apertures 55. Cut out of the central wall panels 51, 52 are divider panels 56 which remain hingedly connected to the wall panels by way of folds 57 and which have gluing tabs 58 each of which in use hinges into a position perpendicular to its associate divider panel 56.

Hingedly connected by way of fold 60 to the central wall panels 51, 52 are first adjacent end walls 581, 59 which in turn are hingedly connected by folds 79 to side walls 61, 62. Each of the side walls 61, 62 is hingedly connected to a base panel 63. The side walls 61, 62 are also hingedly connected by way of further folds 64 to second adjacent end walls connected by fold 78 to edge panels 67, 68 which are themselves connected by way of fold 69 which is coaxial with the fold 53.

Further handle portions 70, 71 are located between the side walls 61, 62 and the first end walls 581, 59 but remain separate therefrom. The further handle portions are hingedly connected to the central wall panels 51, 52 by way of folds 60 and have further handle apertures 72 and a lengthwise fold 73 which is aligned with fold 53.

The first end wall 581 has a projecting flap 75 which is cut from the central wall panel 51 and across which the fold 60 does not extend. In a mirror image location in relation to fold 53 in the other central wall panel is a slightly larger cut out 74. Similarly the second end wall 66 has a flap 77 cut from the edge panel 68 and a corresponding slightly larger cut out 76 is made in edge panel 67.

Assembly of the carton into a form for supplying to an end user is as follows, with particular reference to FIGS. 6 and 7. Glue is first applied to areas X (or alternatively X') and the blank 50 is folded about fold 60 thereby securing the divider panel glue tabs 58 to the side walls 61, 62 and the further handle portions 70, 71 to the handle portions 54 of the central wall panels 51, 52. Glue is then applied to areas Y (or alternatively Y') and the blank is folded about fold 64 thereby securing the edge panels 67, 68 to the further handle portions 70, 71.

Figure 6:
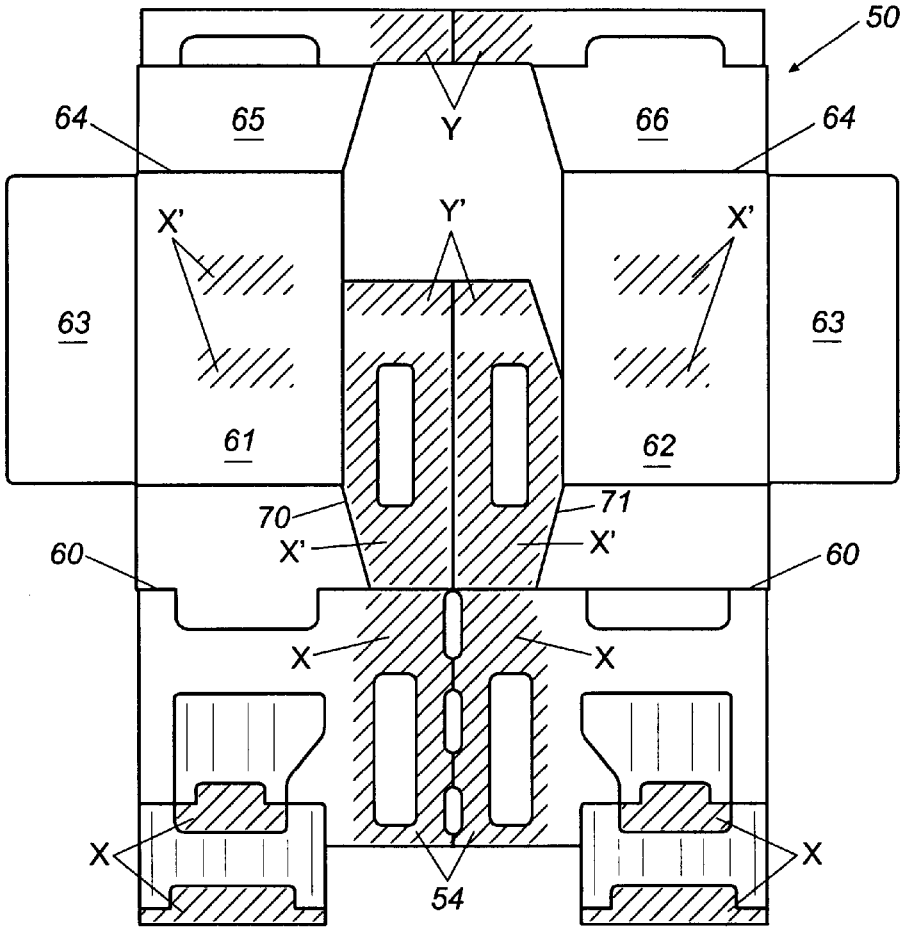
FIG. 6 shows the FIG. 5 blank with gluing locations.

The part-assembled left hand side as shown in FIGS. 6 is then hinged about folds 60 and 78 and about folds 64 and 79. This produces the arrangement shown in FIG. 7. Glue is then applied to areas Z (or alternatively Z') and the blank is folded about the central folds 53, 69 thereby securing the two central panels 51, 52 together and the flaps 75, 77 to the end walls 59, 65.

Figure 11:
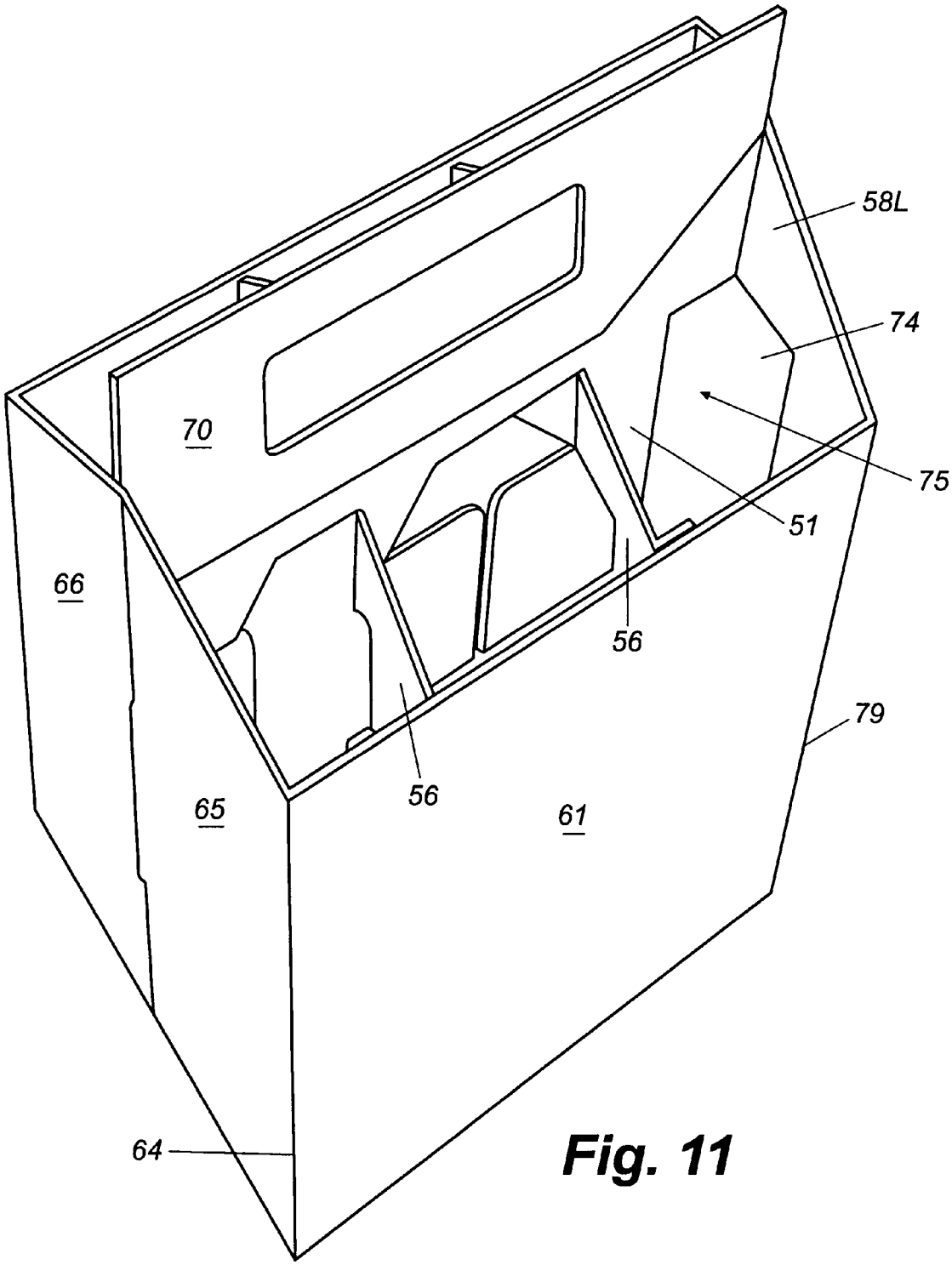
FIG. 11 shows the blank of FIG. 5 in a fully assembled condition.

The carton is now in a flat, assembled condition for supply to an end user who simply has to open up the carton, secure the base panels and insert the products. FIG. 11 shows the carton assembled, immediately prior to insertion of the products.

It will be appreciated that the flaps 75, 77 become adhesively secured to the other end walls 59, 65 of each adjacent pair having passed through the associated cut outs 74, 76. This results in the adjacent pairs of end panels 58, 59 and 65, 66 being coplanar and not being hingable relative to each other. The effect, therefore, is similar to a four-crease device which has been produced from a generally rectangular sheet of paperboard rather than the usual L-shaped piece of board. This is clearly a more efficient use of board.

Figure 5:
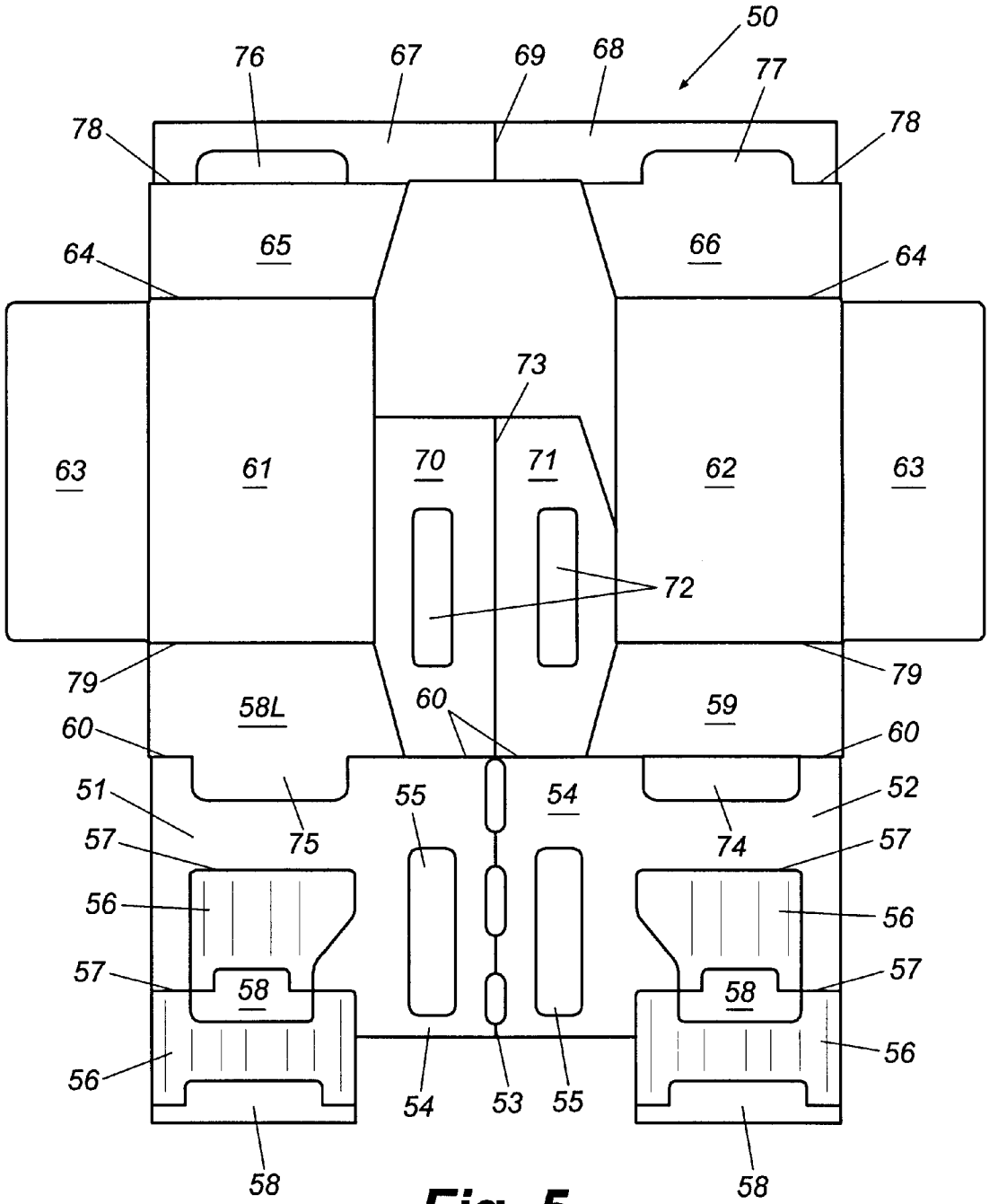
FIG. 5 is a blank for producing a basket type carrier device according to the present invention.
Figure 7:
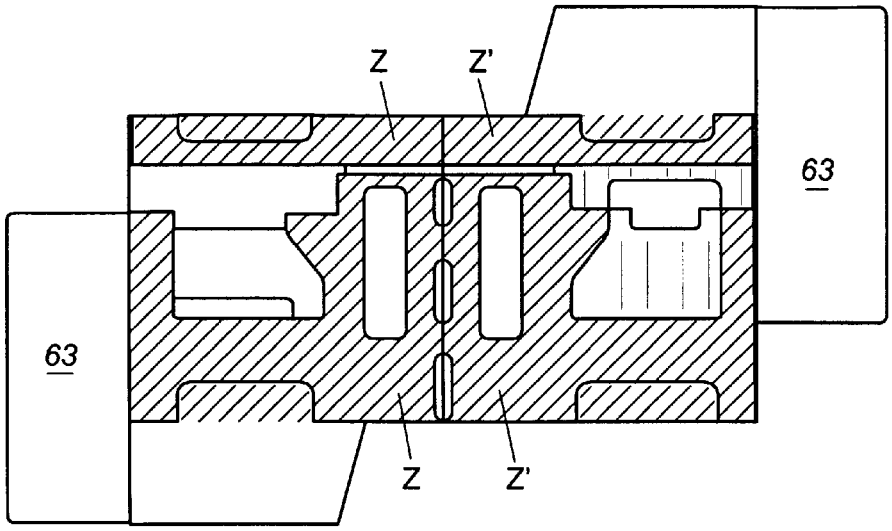
FIG. 7 shows the FIG. 5 blank in a part-assembled condition with further gluing locations.

A further benefit is that a simple modification to the blank results in the production of a six-crease device which has a similar folding and gluing pattern to the device of FIGS. 5 to 7. This me ans that four-crease and six-crease devices can be produced on the same machines imply by running different blanks, both of which are formed from generally rectangular pierces of paperboard.

Figure 8:
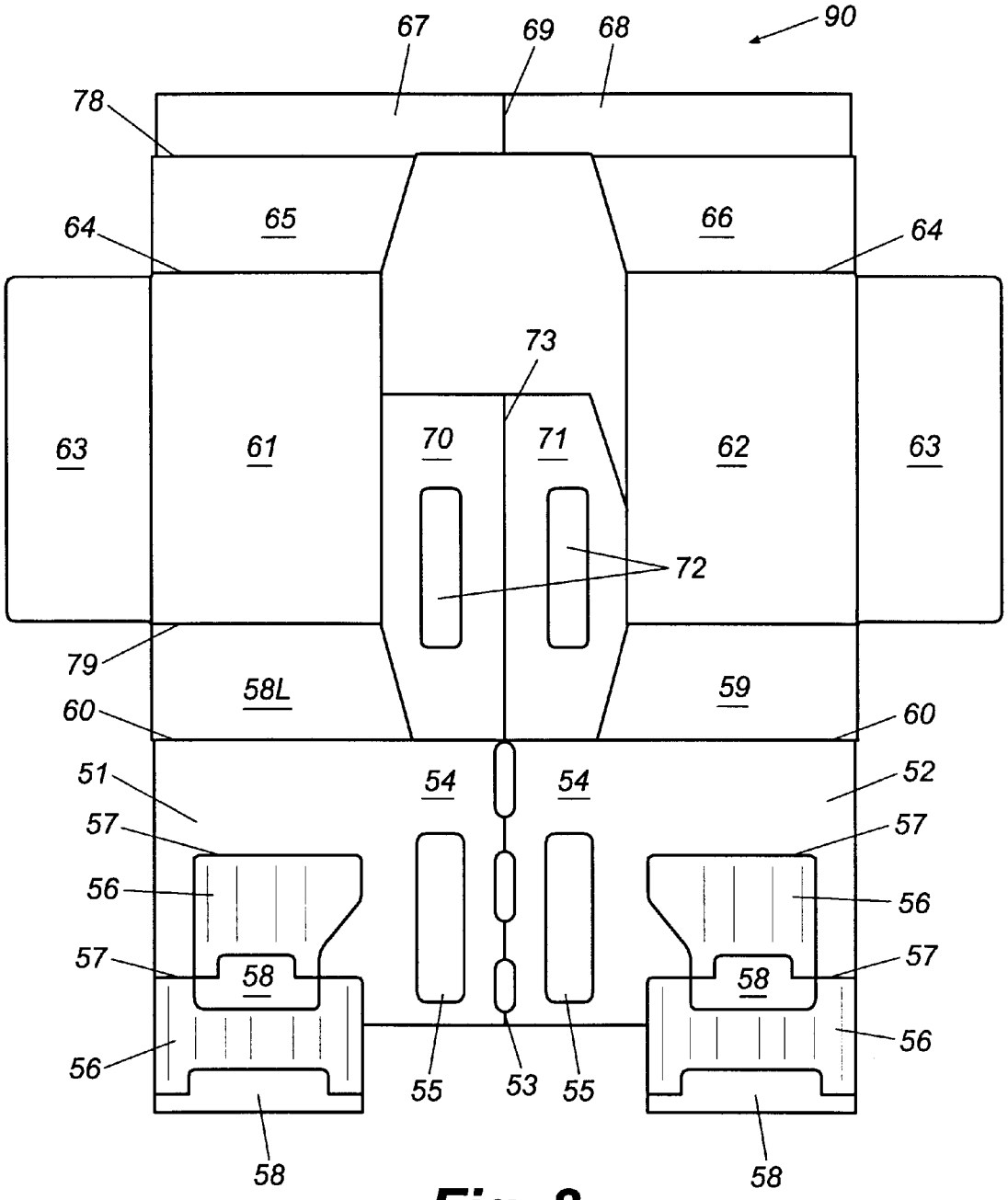
FIG. 8 is a blank for a six-crease basket similar to that of FIG. 5 for the four-crease basket of the present invention but slightly modified for different use.
Figure 9:
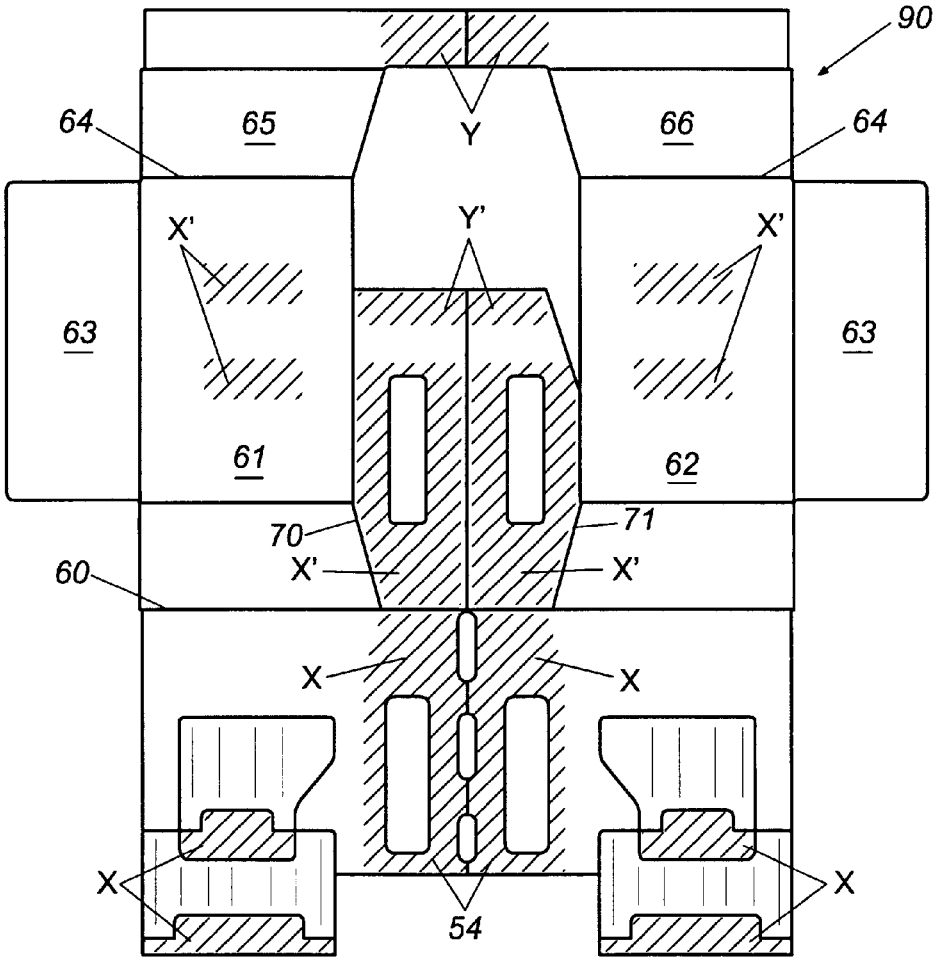
FIG. 9 shows the FIG. 8 blank with gluing locations.
Figure 10:
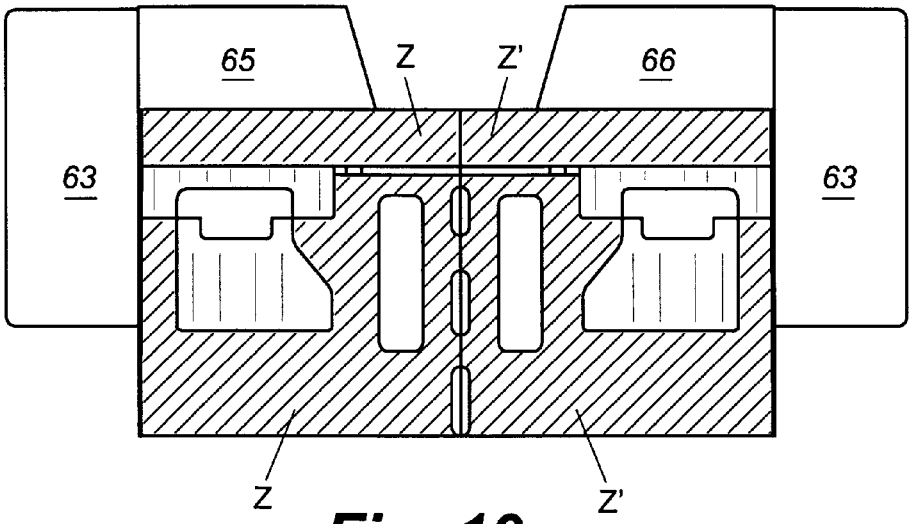
FIG. 10 shows the FIG. 8 blank in a part-assembled condition with further gluing locations.

The modified blank 90 is shown in FIGS. 8 to 10 and is identical in most respects to blank 50 of FIGS. 5 to 7. The blank 90 does not embody the present invention but illustrates instead the adaptation necessary to the four-crease arrangement in order to produce a six-crease arrangement. Corresponding reference numbers have, therefore, been given to corresponding features. The only difference is the omission of the flaps 75, 77 and cut outs 74, 76 in blank 90.

In assembling the blank 90, the same areas X, Y and Z (or alternatively X', Y' or Z') are glued and the folding is identical except for the omission of the intermediate stage of hinging about folds 78, 79. The result is a six-crease device with little modification to the machine. This avoids the need for two different types of machine to run four-crease and six-crease devices.

It will be appreciated that the precise shapes and dimensions of the panels are a matter of design choice, provided they result in a device which can be flattened and subsequently opened again. The device could also be modified to accommodate a different number of bottles/cans. The dividers could also be omitted if desired. Furthermore, other blank layouts are also possible whilst still resulting in similar advantages.

What is claimed is:

1. A basket type carrier device comprising:

a lengthwise extending central wall;

a handle portion attached to said central wall;

article receiving compartments on both sides of the central wall, each receiving compartment being defined by a base wall;

a side wall substantially parallel to the central wall;

a pair of end walls extending between and hingedly connected to the side wall and central wall;

wherein two adjacent end walls of the two compartments are separately defined, but are secured together by means of at least one flap; and wherein said at least one flap is adhesively secured to the other adjacent end wall, so that each pair of adjacent end walls remain in the same plane and are unable to hinge relative to each other due to said adhesive flap attachment between said adjacent end walls.

2. The device as claimed in claim 1 wherein the adhesive attachment of said flaps is located on the surface of the other end walls disposed on the inside of the carrier device.

3. The device as claimed in claim 1 wherein a single flap secures each pair of adjacent end walls.

4. The device as claimed in claim 1 wherein compartment dividers are folded out from the central wall and are adhesively secured to the side walls.

5. The device as claimed in claim 1 wherein the central wall comprises two panels lying flat against each other and hingedly connected along a top edge and incorporating handle apertures thereby to constitute at least a part of the handle portion, said central wall panels being hingedly connected to respective first end walls of a pair of adjacent first end walls.

6. The device as claimed in claim 5 wherein said flap of the first end wall adjacent the central panel is cut from the adjacent central panel and there is a corresponding cut out in the other central panel connected to the other first end wall of the adjacent pair of first end walls, such that in use the flap is located in the cut out when glued to the other first end wall.

7. The device as claimed in claim 5 or 6 wherein that the first end walls are hingedly connected to respective side walls which in turn are hingedly connected to respective end walls of the adjacent pair of second end walls.

8. The device as claimed in claim 7 wherein the second end walls are both hingedly connected to an edge panel, the flap of one of said second adjacent end panels being cut from said edge panel and there is a corresponding cut out in the edge panel adjacent the other of said second end panels, such that in use the flap is located in the cut out in the edge panel which in turn forms a portion of the central wall.

9. The device as claimed in claim 5 wherein further handle panels are provided, hingedly connected to the central wall panels and adhesively secured thereto, said further handle panels also being adhesively secured to the edge panel potion of the central wall.

10. The device as claimed in claim 1 wherein the base walls comprise two panels adapted to be secured together either by adhesive or by interlocking formations.

11. A flattened paperboard blank for forming a basket type carrier device comprising:

a lengthwise extending central wall, article receiving compartments on both sides of the central wall and a handle portion, each receiving compartment being defined by a base wall, a side wall and a pair of end walls, two adjacent end walls of the two compartments, each being separately defined, being secured together by means of at least one flap projecting from one of end walls, which flap or flaps are adhesively secured to the other adjacent end wall, so that each pair of adjacent end walls remain in the same plane as each other and are unable to hinge relative to each other due to said adhesive flap attachment between said adjacent end walls.

12. A basket type carrier device having a lengthwise extending central wall, article receiving compartments on both sides of the central wall and a handle portion, each receiving compartment being defined by a base wall, a side wall substantially parallel to the central wall and a pair of end walls extending between and connected to the side wall and the central wall, the adjacent end walls of the two compartments being separately defined but secured together by means of at least one flap projecting without folding from one of the end walls which flap or flaps are adhesively secured to the other adjacent end wall so that each pair of adjacent end walls remains in the same plane with respect to one another and are unable to hinge relative to each other due to said adhesive flap attachment between said adjacent walls, wherein the central wall comprises two panels lying flat against each other and hingedly connected along a top edge and incorporating handle apertures thereby to constitute at least a part of the handle portion, said central wall panels being hingedly connected to respective first end walls of a pair of adjacent first end walls.

13. The device as claimed in claim 12 wherein said flap of the first end wall adjacent the central panel is cut from the adjacent central panel and there is a corresponding cut out in the other central panel connected to the other first end wall of the adjacent pair of first end walls, such that in use the flap is located in the cut out when glued to the other first end wall.

14. The device as claimed in claim 12 wherein the first end walls are hingedly connected to respective side walls which in turn are hingedly connected to respective end walls of the adjacent pair of second end walls.

15. The device as claim in claim 14 wherein the second end walls are both hingedly connected to an edge panel, the flap of one of said second adjacent end panels being cut from said edge panel and there is a corresponding cut out in the edge panel adjacent the other of said second end panels, such that in use the flap is located in the cut out in the edge panel which in turn forms a portion of the central wall.

16. The device as claimed in claim 12 wherein further handle panels are provided, hingedly connected to the central wall panels and adhesively secured thereto, said further handle panels also being adhesively secured to the edge panel portion of the central wall.

* * * * *